United States Patent [19]

Brand

[11] 3,960,043

[45] June 1, 1976

[54] FILTER CIRCUIT

[75] Inventor: John R. Brand, Mount Prospect, Ill.

[73] Assignee: Warwick Electronics Inc., Chicago, Ill.

[22] Filed: June 24, 1974

[21] Appl. No.: 482,063

[52] U.S. Cl. ..... 84/1.19; 84/1.11; 84/DIG. 9; 307/295; 333/70 R

[51] Int. Cl.[2] ..... G10H 1/00; G10H 5/00

[58] Field of Search ..... 84/1.01, 1.11–1.13, 84/1.19–1.21, 1.24, 1.26, DIG. 8, DIG. 9; 307/295; 333/70 R, 70 A, 70 CR, 70 T, 70 S

[56] References Cited

UNITED STATES PATENTS

| | | | |
|---|---|---|---|
| 2,342,338 | 2/1944 | Hanert | 84/1.2 |
| 2,356,308 | 8/1944 | Fredendall | 333/70 R X |
| 2,725,534 | 11/1955 | Hemphill | 333/70 R X |
| 3,136,838 | 6/1964 | Heytow | 84/1.11 |
| 3,147,333 | 9/1964 | Wayne, Jr. | 84/DIG. 9 |
| 3,296,546 | 1/1967 | Schneider, Jr. | 333/70 R X |
| 3,311,758 | 3/1967 | Irons | 333/70 R X |
| 3,522,457 | 8/1970 | Perra | 307/295 |
| 3,538,805 | 11/1970 | Vetrecht | 84/1.11 |
| 3,725,560 | 4/1973 | Robinson et al. | 84/1.01 |
| 3,749,809 | 7/1973 | Niinomi | 84/1.24 |
| 3,767,833 | 10/1973 | Noble et al. | 84/1.01 |
| 3,806,624 | 4/1974 | Kniepkamp et al. | 84/1.26 X |
| 3,821,461 | 6/1974 | Mieda | 84/1.19 |

OTHER PUBLICATIONS

C. L. Searle et al., Elementary Circuit Properties of Transistors, Semiconductor Electronics Education Committee, vol. 3, John Wiley & Sons, Inc., Second Printing, Oct., 1966, Copyright 1964, pp. 227–230.

*Primary Examiner*—L. T. Hix
*Assistant Examiner*—Stanley J. Witkowski
*Attorney, Agent, or Firm*—Wegner, Stellman, McCord, Wiles & Wood

[57] ABSTRACT

A filter circuit for use in a musical instrument, such as an electronic organ, eliminating undesirable keying transients introduced into the signals provided by tone generators of the organ. The filter circuit includes a bandpass filter filtering from the keyed tone generator signals frequencies which are below and above the desired audio frequency spectrum of the output sound.

11 Claims, 5 Drawing Figures

FILTER CIRCUIT

BACKGROUND OF THE INVENTION

1. Field of the Invention

This invention relates to electronic musical instruments and in particular to means for eliminating undesirable keying transients in such instruments.

2. Description of the Prior Art

In electronic musical instruments, such as electronic organs, a desired output sound is obtained by selective depressions of keys which effectively start and stop delivery to the amplifier of signals generated by a plurality of tone generators. The sudden starting and stopping of the signal delivery to the amplifier introduces into the transmitted signal spurious side band frequencies which produce audible clicks and thumps in the output sound. These keying transients are annoying and substantial effort has been expended in an attempt to eliminate or reduce them to an acceptable level.

Another cause of key clicks and thumps in such instruments is the DC offset generated by conventional electronic keyers. Conventional methods to eliminate these transients include relatively costly balanced modulators, field effect transistors in series shunt arrangements, and light dependent resistors.

The problem of such keying transients generally was considered in U.S. Pat. No. 2,228,119 of Theodore P. Kinn relative to the production thereof in radio telegraphy. As pointed out in that patent, it was well recognized that the undesirable key clicks were caused by a high order of side band frequencies produced by the sudden starting and stopping of the oscillations. The patentee indicates that in order to eliminate the cause of such key clicks, it is necessary to provide some means whereby the oscillations are controlled to start and stop gradually instead of abruptly. To do this, the patentee teaches the use of reactive elements for modifying the shape of the transmitted wave sound and forming a critically damped oscillatory circuit.

An early patent utilizing this method of reducing the keying transients in electronic organs was that of Leslie A. Bourn U.S. Pat. No. 2,522,923 wherein condensers were provided in combination with resistors for slowing down the rate of increase of the keyed signal.

The soft keying concept is disclosed in detail in U.S. Pat. No. 2,089,781 of Werner Buschbeck. As pointed out therein, it was conventional to use electrical or mechanical retarding means to operate a modulation stage with a keying lag. In the structure of the patent, a transmitter stage controlled by a key is gradually keyed in and out through the intermediary of suitable retarding means to ensure the desirable soft keying.

In the Stanley Cutler U.S. Pat. No. 3,514,723 owned by the assignee hereof, a tone control circuit is provided utilizing a potentiometer for selectively attenuating or boosting either the high or low frequencies with respect to a given reference frequency. The circuit differentially adjusts the network's transmission characteristics to function as either a low pass filter, a high pass filter, or a frequency-flat transmission channel.

The use of delaying circuitry to provide soft keying by reducing the number of side band frequencies is not completely satisfactory in that this technique introduces the disadvantage of preventing an instantaneous response to the player's operation of the keys. Such soft keying produces a time delay effect which is completely different from the normal instantaneous effect, e.g., as obtained in the playing of a conventional piano wherein the sound appears substantially simultaneously within the striking of the key. Even a small delay in the buildup of the sound is sensed by the player of the organ so as to make the organ seem somewhat unresponsive. Thus, while reducing the click problem, the soft keying technique introduces a different, unnatural response problem.

SUMMARY OF THE INVENTION

The present invention comprehends an improved musical instrument control circuit which effectively eliminates undesirable keying transients so as to eliminate key click and key thump sounds while permitting the sound to start substantially simultaneously with the actuation of the keys. More specifically, the present invention comprehends the utilization of a filter circuit for filtering from the keyed signals the keying transient frequencies which are below and above the desired audio frequency spectrum of the output sound. Any frequencies introduced by the keying operation which are within the desired audio frequency spectrum are normally considered undetectible.

In the illustrated embodiment, the keyers comprise electronic keyers which, in the prior art, are particularly susceptible to undesirable keying transient click and thump sounds. Thus, the present invention is highly advantageous in the use thereof with electronic organs having electronic keyers.

The present filter circuit further eliminates unwanted spurious frequency components in the output sound arising from the use of a DC offset in the signal which, as a result of the sudden rise of the DC voltage, produces similar undesirable signal components.

The filter circuit of the present invention utilizes a bandpass filter between the keyer and the electromechanical transducer portion of the musical instrument. The filter may include a number of input portions and may be arranged to provide different band widths in the output sounds produced by different input signals applied to the respective different input portions. Illustratively, the filter circuit may be arranged to provide a relatively large band width for the lowest frequency input signals and narrower band widths for the higher frequency input signals applied to different input portions of the filter.

In the illustrated embodiment, the filter signal modifier circuit includes a first semiconductor device having an emitter, a first impedance element having first and second terminals, the first terminal being connected to the emitter, signal input means connected to the other terminal of the first impedance element, a second impedance element having a terminal thereof connected to the signal input means and the other terminal of the first impedance element and forming a tuned circuit therewith, and a second semiconductor device having a base connected to the connection of the signal input means, the other terminal of the first impedance element and the terminal of the second impedance element.

More specifically, in the illustrated embodiment, the filter may further include a second such signal modifier circuit connected in series with the first named signal modifier circuit for modifying different input signals provided to the respective signal input means thereof, the emitter of the second semiconductor of the first named signal modifier circuit comprising the emitter of the first semiconductor device of the second signal modifier circuit.

By suitably selecting the tuning of the tuned circuit portions of the filter, accurate control of the desired band width of the output sounds is readily obtained thereby effectively eliminating the undesirable clicks and thumps produced by the keyed transients while yet permitting the instantaneous attack and decay of the output sound by manipulation of the selected keys.

Thus, the keying transient eliminating means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
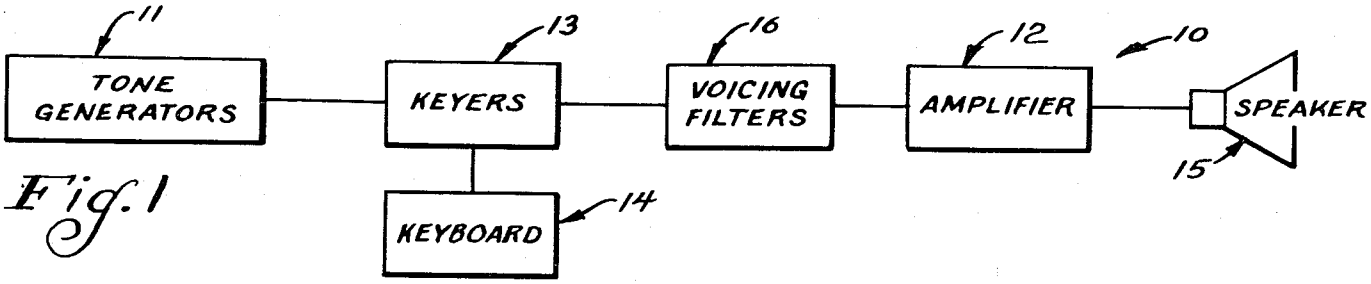
FIG. 1 is a block diagram illustrating the components of an electronic organ including a keying transient eliminating filter embodying the invention.

In the exemplary embodiment of the invention as disclosed in the drawing, an electronic musical instrument, illustratively comprising an electronic organ generally designated 10, is shown to include a plurality of tone generators 11 for delivering signals to an amplifier generally designated 12 under the control of electronic keyers 13 which are suitably selectively operated by a manually operated keyboard 14. The keyed signals are amplified by amplifier 12 for suitable operation of a conventional loudspeaker 15 producing the desired organ sounds. To provide an improved clickless and thumpless output, a novel voicing filter 16 is provided between the keyers 13 and amplifier 12 which, as indicated briefly above, eliminates the undesirable keying transients introduced into the signals from the tone generators 11 by the operation of the keyers 13. The voicing filter 16 provides such transient free signals to the amplifier while yet maintaining substantially instantaneous wave front characteristics of the keyed signals, thereby providing a substantially improved sound output in speaker 15.

Figure 4:
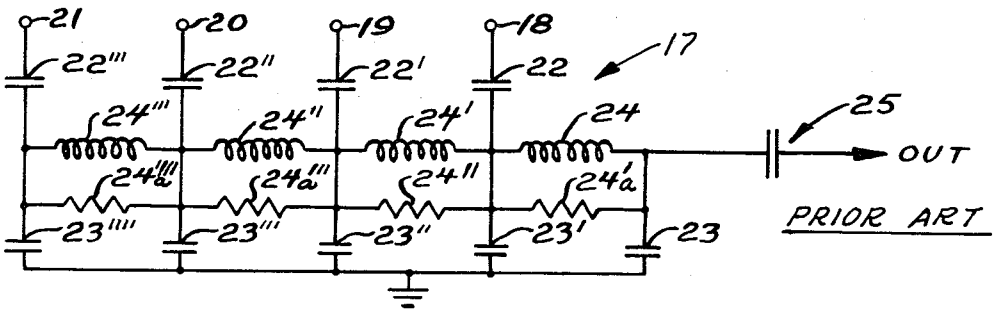
FIG. 4 is a schematic wiring diagram illustrating a conventional voicing filter.

As shown in FIG. 4, a typical voicing filter, such as may be used to provide a flute sound in an electronic organ, comprises a ladder filter generally designated 17 wherein the respective input portions 18, 19, 20 and 21 are connected through suitable capacitors 22, 22′, 22″ and 22‴, 23′, 23″, 23‴ and 23⁗ 24′, 24″, 24‴ and resistors 24a′, 24a″ and 24a‴ to ground, thereby attenuating high frequency components of the keyed signals. Filter 17 filters out the undesirble high frequencies and provides a substantially sine wave frequency at the output 25. As this filter comprises a ladder filter, reflections are caused which produce an uneven response at the lower frequencies, as illustrated in the output curves shown in FIG. 5.

Figure 5:
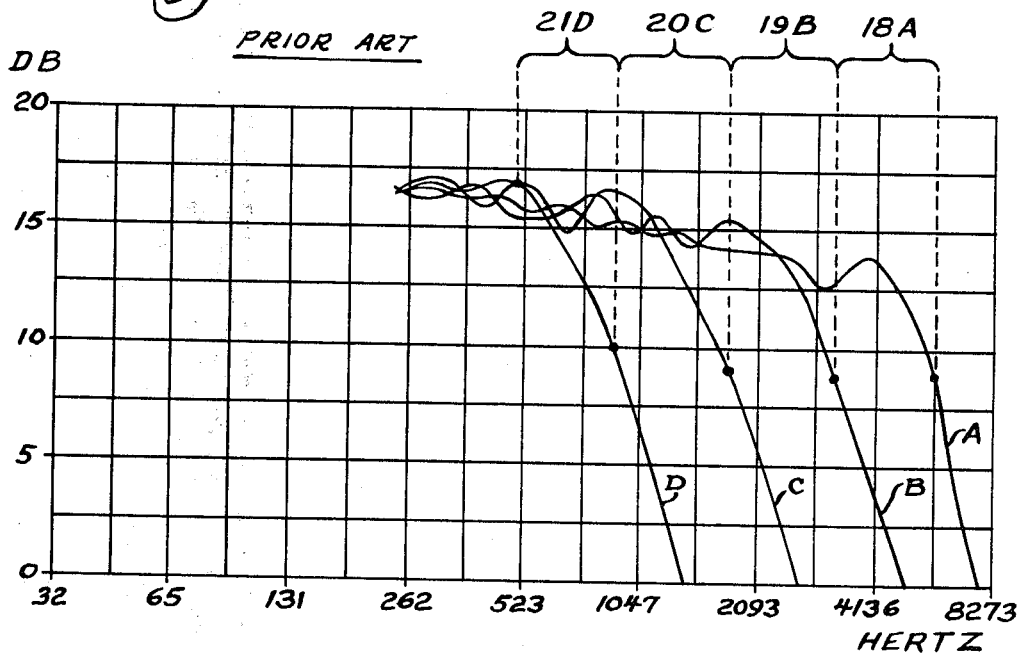
FIG. 5 is a chart showing the frequency response characteristics of the conventional filter of FIG. 4.

More specifically, assuming that a keyed signal is delivered to input 18, the response of the filter is illustrated by curve A in FIG. 5. The desired range of frequencies from the output of the filter produced by the input signal at input portion 18 are illustrated in the range identified 18A in FIG. 5. Not only is there a variation in the amplitude of the output response in the desired range, but also a substantial response is obtained in the lower frequencies produced by the keying transients.

Referring to Curve B, the response of the conventional filter 17 to a signal applied to input 19 may be seen to be uneven in the desired range 19B and also produces a substantial low frequency thump portion. The Curves C and D illustrate similar effects relative to signals applied to inputs 20 and 21. Thus, as illustrated in FIG. 5, in the prior art filter structure, the response is attenuated at the high frequencies but provides irregular response in the desired range and further permits undesirable lower frequency transmission therethrough which would produce the undesirable thumps as a result of the keying action.

Figure 2:
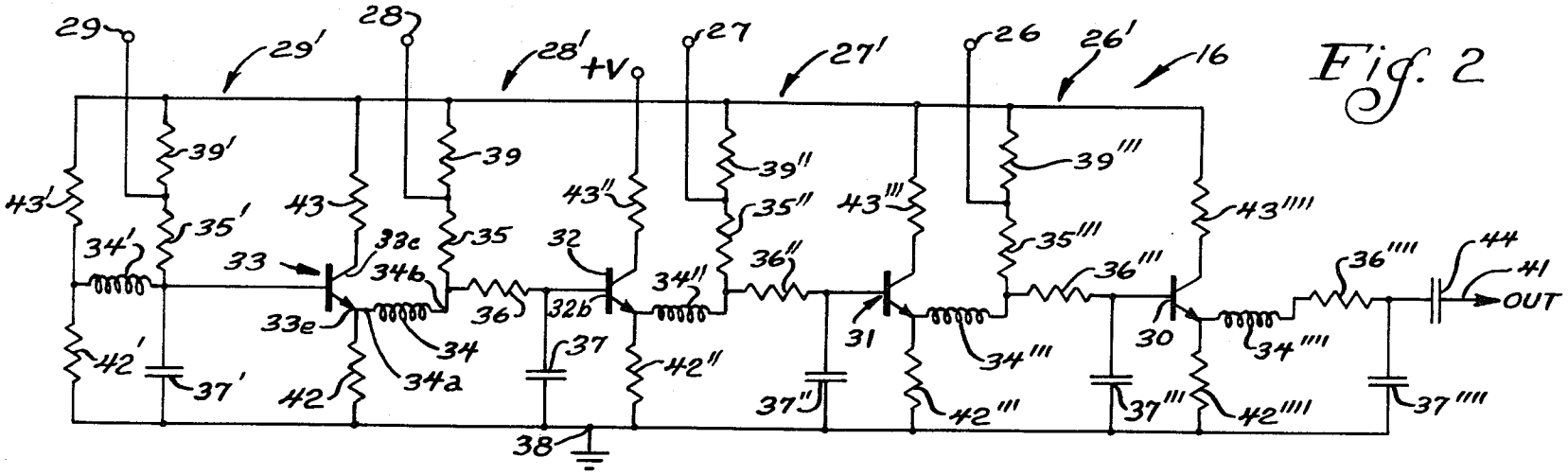
FIG. 2 is a schematic wiring diagram of the filter.
Figure 3:
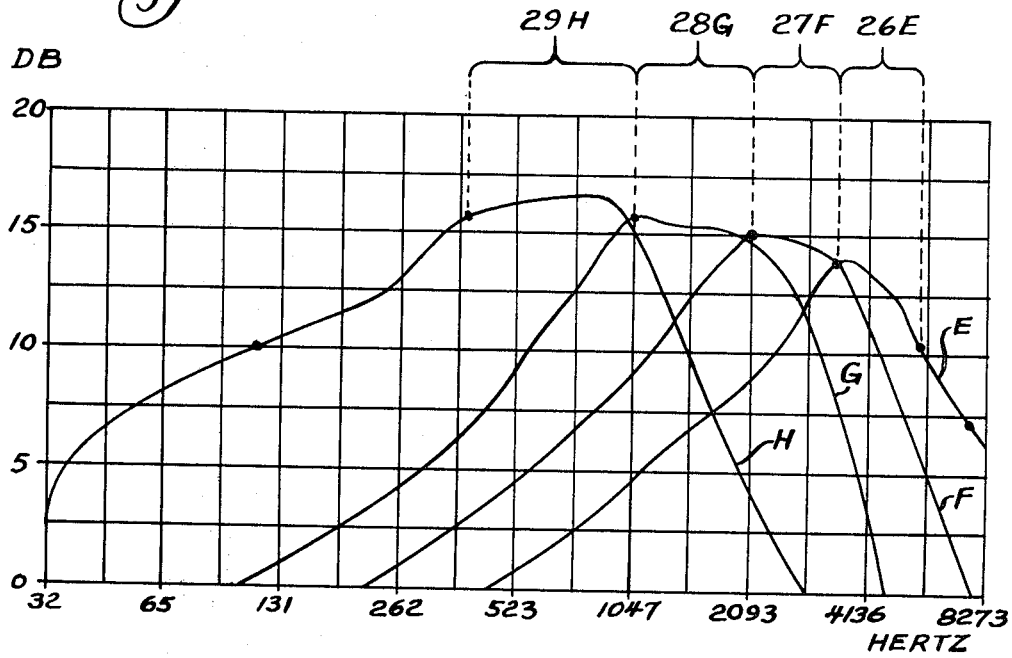
FIG. 3 is a chart showing the frequency response characteristics of the filter.

Referring now to FIGS. 2 and 3, the improved voicing filter 16 is shown to provide a frequency response which is attenuated both above and below the desired range so as to effectively eliminate clicks and thumps in the output sound without softening the keying action.

More specifically, as shown in FIG. 2, filter 16 defines a multistage filter having input portions 26, 27, 28 and 29 to the respective stages 26′, 27′, 28′ and 29′ thereof. Curve E, in FIG. 3, represents the response obtained from signals applied to input portion 26 in the range 26E. Curve F illustrates the response relative to signals applied to input 27 in range 27F. Curve G illustrates the response relative to signals applied to input 28 in range 28G. Curve H illustrates the response relative to signals applied to input 29 in range 29H. As illustrated, the band width of the response H may be greater than the band width of the responses E, F and G.

Further, as shown in FIG. 3, the crossover points of the adjacent curves may be closely adjacent the boundary between the two ranges thereof so that an input signal applied to either of the two adjacent input portions having a frequency corresponding to the boundary frequency will provide a similar response in contradistinction to the substantially different response which is obtained with the conventional filter circuit, as illustrated by the curves of FIG. 5.

Referring now more specifically to FIG. 2, the filter 16 includes a plurality of NPN transistors connected in a common collector mode. Thus, in the illustrated embodiment, the filter includes transistors 30, 31, 32 and 33. Illustratively, the emitter **33*e* of transistor 33 is connected to one terminal 34*a* of an inductor 34. The other terminal 34*b* of inductor 34 is connected through a resistor 35 to input portion 28 and through a second resistor 36 to a capacitor 37 which, in turn, is connected to ground 38. Input portion 28 is connected through a third resistor 39 to the + voltage supply 40. The use of the transistors in the common collector mode provides a low output impedance and high input impedance. More specifically, as shown in FIG. 2, emitter 33*e* is at virtual AC ground due to the low output impedance of the transistor 33. As the inductor 34 provides a low impedance to low frequency components of a signal applied to input portion 28, the low frequency components are effectively attenuated by passage to ground 38 through grounding resistor 42. Resultingly, an isolation between the filter stages is obtained which prevents reflection and thereby eliminates the irregular lefthand portion of the response curves as occurs in the use of the prior art ladder type filter, as illustrated in FIG. 5**.

High frequency components of the signal applied to input 28 are delivered through resistors 35 and 36 to the junction of base 32b of transistor 32 and of the capacitor 37. As the capacitor 37 presents a low impedance at high frequencies, the high frequency components are attenuated by passing to ground, thereby limiting transmission of the high frequencies.

As an overall result, both the low frequency and the high frequency components of the signal are attenuated resulting in a narrow bandpass transmission of the keyed signal frequencies producing the desired output sound without the undesirable click and thump characteristics of the prior art filter outputs. Transients falling within the bandpass characteristic of the filter are not objectionable to the ear as they merely augment the desired frequencies of the selected voice.

The inductors 34 and capacitors 37 may be suitably selected to provide a tuned circuit giving a tuned response of the filter so as to provide desired preselection of the band width. As discussed briefly above, the band width of the response relative to input portion 29 may be made broader than that of the responses relative to the other input portions by suitably selecting the values of the capacitor 37', inductor 34' and grounding resistor 42'. Thus, resistor 42' may differ from resistor 42 connected from the transmitter emitter 33e to ground to provide the desired different band width characteristics.

As shown, the collector 33c of the transistor may be connected to voltage supply 40 through a suitable resistor 43. The stages relative to inputs 26 and 27 may be similar to the stage described above relative to input 28. A conventional output capacitor 44 may be provided as shown.

In one illustrative filter embodying the invention, the parameters of the discussed components were as follows:

| | | |
|---|---|---|
| Transistors | 30, 31, 32, 33 | 2n-3904 |
| Resistors | 35, 35', 35'', 35''' | 100 Kohms |
| | 36, 36', 36'', 36''' | 1.2 Kohms |
| | 39, 39', 39', 39''' | 10 Kohms |
| | 42, 42', 42''' | 33 Kohns |
| | 42' | 10 Kohms |
| | 42'''' | 15 Kohms |
| | 43, 43', 43''', 43'''' | 1 Kohm |
| | 43' | 6.8 Kohms |
| Capacitors | 37 | .033 microfarads |
| | 37' | .039 microfarads |
| Capacitors | 37'' | .022 microfarads |
| | 37''' | .015 microfarads |
| | 37'''' | .01 microfarads |
| | 44 | .15 microfarads |
| Inductors | 34 | 500 mh. |
| | 34' | 2 h. |
| | 34'' | 250 mh. |
| | 34''' | 125 mh. |
| | 34'''' | 62.5 mh. |

Effectively, the input portions to the filter are connected between righthand filter portions and lefthand filter portions to provide the desired preselected narrow band width response characteristics. In this respect, the several stages of the filter are defined by a first semiconductor device having an emitter, a first impedance element having first and second terminals, the first terminal being connected to the emitter, signal input means connected to the other terminal of the first impedance element, a second impedance element having a terminal thereof connected to the signal input means and the other terminal of the first impedance element and forming a tuned circuit therewith, and a second semiconductor device having a base connected to the connection of the signal input means, the other terminal of the first impedance element and the terminal of the second impedance element.

Further, as shown in the illustrated embodiment, a second such signal modifier circuit is connected in series with the first named signal modifier circuit for modifying different input signals provided to the respective signal input means thereof, the emitter of the second semiconductor of the first named signal modifier circuit comprising the emitter of the first semiconductor device of the second signal modifier circuit.

The filter of the present invention provides facilitated control of the response characteristics by suitable selection of the tuned circuit parameters thereby effectively eliminating the undesirable clicks and thumps resulting from keying transients introduced by the electronic keyer of the musical instrument. This is effected without the need for soft keying, thereby providing an improved playing action of the musical instrument.

The present filter construction further offers the highly desirable advantage of permitting the DC offset to be increased for the keyers suitably to give a "strike" tone effect. The increased DC offset generates substantially instantaneous, high amplitude sinusoidal type of output from the bandpass filter, which, being in the desired frequency range, may provide a percussive type striking sound effect similar to that produced by the conventional forceful striking of a piano string.

The foregoing disclosure of specific embodiments is illustrative of the board inventive concepts comprehended by the invention.

The embodiments of the invention in which an exclusive property or privilege is claimed are defined as follows:

1. In an electronic musical instrument having a plurality of tone generators, keyers for keying signals generated by said tone generators, and an electromechanical transducer for producing output sounds corresponding to the keyed signals, circuit means for effectively eliminating undesirable keying transients introduced into said signals by the keying thereof, comprising a multistage bandpass filter connected between said keyers and said transducer wherein each stage is provided with a single inductive impedance element and provides a band width having substantially abrupt drop-off at the opposite ends thereof preselected to filter cleanly from the keyed signals delivered thereto from said keyer frequencies which are below and above the desired audio frequency spectrum of the output sound, the output impedance of each stage being lower than the input impedance of each stage, the band width being different for different stages, said filter stages respectively defining means for substantially equally attenuating high frequency components of said input keyed signals delivered to each of said input portions, and differently attenuating low frequency components thereof, each filter stage including a semiconductor device connected to the keyers, means for connecting one terminal of the inductive impedance element to said semiconductor device, and a capacitive impedance element connected to the other terminal of said inductance impedance and to the semiconductor device of the succeeding filter stage.

2. In an electronic musical instrument having a plurality of tone generators, a keyer for selectively keying a plurality of different signals generated by said tone generators, and an electromechanical transducer for producing output sounds corresponding to the keyed signals, circuit means for effectively eliminating undesirable keying transients introduced into said signals by the keying thereof, comprising a bandpass filter having a plurality of signal input means for respectively receiving input signals from said keyer and filtering from said keyed signals frequencies which are below and above the desired audio frequency spectrum of the output sounds, the drop-off in the frequencies below and above said desired spectrum being abrupt, said filter including means for causing the output signals provided to different input portions to have different preselected band widths, said filter having an output portion connected to said transducer for delivering the filtered keyed output signals to said transducer, said bandpass filter defining a signal modifier circuit including a first semiconductor device having an emitter, a first impedance element having first and second terminals, said first terminal being connected to said emitter, the other of said terminals of said first impedance element being connected to a signal input means, a second impedance element having one terminal thereof connected to said other terminal of said first impedance element and forming a tuned circuit with said first impedance element, and a second semiconductor device having a base connected to the connection of the signal input means, said other terminal of said first impedance element and said terminal of said second impedance element whereby a signal received at said connection has high frequencies thereof attenuated by said first impedance element and low frequencies thereof attenuated by said second impedance element.

3. The electronic musical instrument circuit means of claim 2 wherein said filter comprises means for substantially equally attenuating high frequency components of said input keyed signals delivered to each of said input portions, and differently attenuating low frequency components thereof.

4. The electronic musical instrument circuit means of claim 2 wherein a second such signal modifier circuit is connected in series with said first named signal modifier circuit for modifying different input signals provided to the respective signal input means thereof, the emitter of said second semiconductor of said first named signal modifier circuit comprising the emitter of said first semiconductor device of said second signal modifier circuit.

5. The electronic musical instrument circuit means of claim 2 wherein said connection of said signal input means, said other terminal of said first impedance element, and said terminal of said second impedance element comprises resistor means.

6. The electronic musical instrument circuit means of claim 2 wherein said first impedance element comprises an inductor.

7. The electronic musical instrument circuit means of claim 2 wherein said second impedance element comprises a capacitor.

8. The electronic musical instrument circuit means of claim 2 wherein said first semiconductor device has a base connected to a second signal input means, and a second tuned circuit including third and fourth impedance elements.

9. The electronic musical instrument circuit means of claim 2 wherein said first semiconductor device has a base connected to a second signal input means, and a second tuned circuit including third and fourth impedance elements, said first and third impedance elements comprising inductors and said second and fourth impedance elements comprise capacitors.

10. In an electronic organ having means for providing a tone signal and an output means, a filtering circuit for passing a selected band of frequencies contained in said signal to said output means, said filtering circuit comprising:

a set of series connected stages each of which comprises a first semiconductor device having first and second terminals;

a first impedance element having first and second terminals, said first terminal being connected to said first semiconductor terminal;

signal input means connected to the other said terminal of said first impedance element; and a second impedance element having a terminal thereof connected to said signal input means and said other terminal of said first impedance element and forming a tuned circuit therewith, the second terminal of said semiconductor device being connected to the preceding stage and the succeeding stage being connected to the signal input means connection.

11. In an electronic musical instrument having a tone generator, a keyer for keying signals generated by said tone generator, and an electromechanical transducer for producing an output sound corresponding to the keyed signals, circuit means for effectively eliminating undesirable keying transients introduced into said signals by the keying thereof, comprising a bandpass filter connected between said keyer and said transducer having a generally flat band width having substantially abrupt drop-off at the opposite ends thereof preselected to filter cleanly from said keyed signals frequencies which are below and above the desired audio frequency spectrum of the output sound, said bandpass filter including a first semiconductor device having an emitter, an inductor having first and second terminals, said first terminal being connected to said emitter, signal input means connected to said second terminal of said inductor, a capacitor having a terminal thereof connected to said signal input means and said second terminal of said inductor and forming a tuned circuit therewith, and a second semiconductor device having a base, and resistance means connecting said signal input means, said second terminal of said inductor, said terminal of said capacitor, and said second semiconductor device base, whereby a signal received at said connection has high frequencies thereof attenuated by said inductor and low frequencies thereof attenuated by said capacitor.

* * * * *